US006170499B1

(12) United States Patent
Lin

(10) Patent No.: US 6,170,499 B1
(45) Date of Patent: Jan. 9, 2001

(54) PARASOL WITH VENTILATION

(76) Inventor: Yao-Chin Lin, No. 21, Alley 24, Lane 273, Sec. 3, Tungmen Rd., Tainan (TW)

( * ) Notice: Under 35 U.S.C. 154(b), the term of this patent shall be extended for 0 days.

(21) Appl. No.: 09/206,405

(22) Filed: Dec. 7, 1998

(30) Foreign Application Priority Data

Oct. 27, 1998 (TW) ..... 87217901

(51) Int. Cl.[7] ..... A45B 25/26
(52) U.S. Cl. ..... 135/33.7; 135/31; 135/94
(58) Field of Search ..... 135/15.1, 29, 31, 135/32, 33.2, 33.4, 33.5, 33.7

(56) References Cited

U.S. PATENT DOCUMENTS 5,305,770 * 4/1994 DeMarco ..... 135/26
5,368,055 * 11/1994 Johnson ..... 135/33.7
5,482,069 * 1/1996 Lee ..... 135/31
5,601,103 * 2/1997 Dubinsky ..... 135/33.7
5,640,984 * 6/1997 Dubunsky ..... 135/33.2
5,678,586 * 10/1997 Baksch ..... 135/33.7
5,890,506 * 4/1999 Kupferman ..... 135/33.2
6,006,769 * 12/1999 Lin ..... 135/33.7

* cited by examiner

*Primary Examiner*—Beth Stephan
(74) *Attorney, Agent, or Firm*—Bacon & Thomas, PLLC

(57) ABSTRACT

An improved parasol with an improved ventilation system. The parasol, includes a foldable frame with concentric first and second panels. The radius of the first panel is shorter than the length of the rib of the parasol. The second panel is annular in shape and covers the area from the outer periphery of the first panel to the outermost edge of the parasol. A cord is provided between the second panel's inner periphery and the stretchers to enlarge the gaps at the areas where the first and the second panel overlap. A plurality of elastic loops are provided at the first panel's outer periphery to provide elasticity to the first panel to prevent the first panel from turning inside out in strong wind.

2 Claims, 5 Drawing Sheets

PARASOL WITH VENTILATION

BACKGROUND OF THE INVENTION

1. Field of the Invention

The present invention relates to an improved parasol, more particularly, to a parasol with improved ventilation.

2. Description of the Related Art

Generally, a parasol is a device for shielding people from the sunlight. It usually includes a frame and a panel. The frame includes a shaft and a plurality of ribs and stretchers that are pivotally connected to the shaft. The panel is attached to and covers the ribs.

When a conventional parasol is held by a user it gives shade to the user, but the ventilation between the space below the parasol and the ambient air tends to be inadequate, especially when the sunlight is strong. Two different kinds of parasols have been developed previously to attempt to solve this problem. The first example is illustrated in FIG. 5. The parasol panel as shown includes a primary panel (30) and a secondary panel (31) situated concentrically with respect to the primary panel (30), a shaft (40) securely located in the center of the primary panel (30) and the secondary panel (31), and a plurality of primary ribs (41) radially extending between the center and the peripheral edge of the primary panel (30), and a plurality of secondary ribs (42) with a first end which is pivotally connected to one of the corresponding primary ribs (41) and a second end which is slidably moveable in relation to the shaft (40).

The primary panel (30) has a plurality of openings (301) positioned between adjacent ribs (41). The diameter of the secondary panel (31) is shorter than a radius of the primary panel (30) but it is longer than a length of the diameter between the connection point of the stretchers (42) and the ribs (41), such that when the primary panel (30) extends along the extension of the secondary ribs (42), the secondary panel (31) covers the openings (301) in the primary panel (30). Air is thus able to flow from an outer periphery (311) of the secondary panel (31) through the openings (301) to the space under the parasol to improve the ventilation.

FIG. 6 shows another prior art parasol panel and it includes a primary panel (50), a secondary panel (51) located concentrically with respect to the primary panel (50), a shaft (60) securely located at the center of the primary panel (50) and the secondary panel (51), a plurality of ribs (61) radially extending between the center and the peripheral edge of the primary panel (50) and a plurality of secondary ribs (62) with a first end which is pivotally connected to a corresponding one of the primary ribs (61) and a second end which is slidably moveable in relation to the shaft (60). The central part of the primary panel (50) includes a porous, net-like material (501). The secondary panel (51) has a radius shorter than that of the primary panel (50) but it extends over the porous material (501) so that air can flow from the gap between the outer periphery (511) of the secondary panel (51) and the primary panel (50).

Neither of the two parasols actually provides an adequate solution for the ventilation problem.

In FIG. 5, since the secondary panel (31,51) is attached to the same frame segments as the primary panel (30,50), the gap between the two panels is too small to permit an adequate flow of air therethrough.

In FIGS. 5 or 6, with the exception of the holes or netting, the primary panel (30,50) completely covers the primary ribs (41,61). A large portion of the secondary panel (31,51) covers the material of the primary panel (30,50), which duplicates the function of the panel (30,50) and therefore is a waste of material.

The invention aims to provide an improved structure for a parasol which not only retains proper ventilation but adds to its strength and minimizes damage to the primary and/or secondary panel while saving material in the overall fabrication of the parasol.

SUMMARY OF THE INVENTION

The main object of the present invention is to provide an improved parasol which can provide proper ventilation under the parasol's panel, with a minimum usage of panel material.

Another object of the present invention is to provide an improved connection between the primary ribs and stretchers to withstand strong winds.

DETAILED DESCRIPTION OF PREFERRED EMBODIMENT

Figure 1:
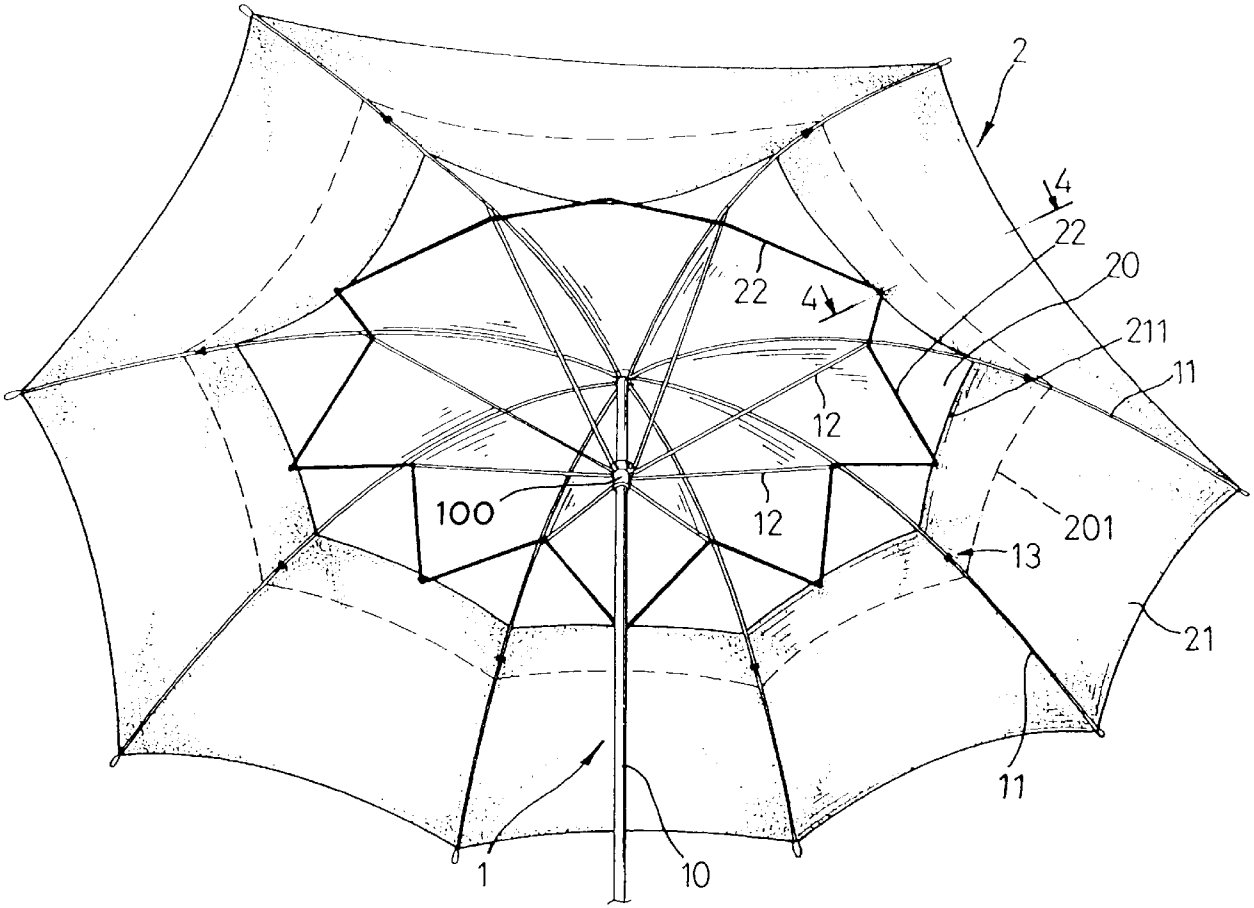
FIG. 1 is a bottom perspective view of a parasol in accordance with the present invention.

An improved parasol of the present invention is shown in FIG. 1. The parasol (1) comprises of two main parts: a frame and a panel. As with a conventional parasol, the frame includes a shaft (10), a plurality of ribs (11) radially and pivotally connected to the top of the shaft (10), a nest (100) movably connected with the shaft (10), and a plurality of stretchers (12) each radially and pivotally connected between the nest (100) and the middle portion of a corresponding rib (11). The overall panel (2) comprises a first panel (20) and a second panel (21) concentrically attached to the ribs (11). The first panel (20) is roughly circular with a radius extending from the shaft (10) to a point farther than the joint (101) of the stretcher (12) and the corresponding rib (11). The first panel (20) extends from its center to its outer periphery (201). The second panel (21) is also roughly circular and extends from a point outside of the stretchers (12) to the outmost point of the rib (11). A cord (22), preferably elastic, connects the stretcher (12) to the ribs (11) at the joint (101) and the inner periphery of the second panel (21). The first panel (20) and the second panel (21) overlap each other.

The two panels (20,21) overlap each other, and the width of the overlap can also be varied to optimize the effect of ventilation and/or meet economic requirements.

Figure 3:
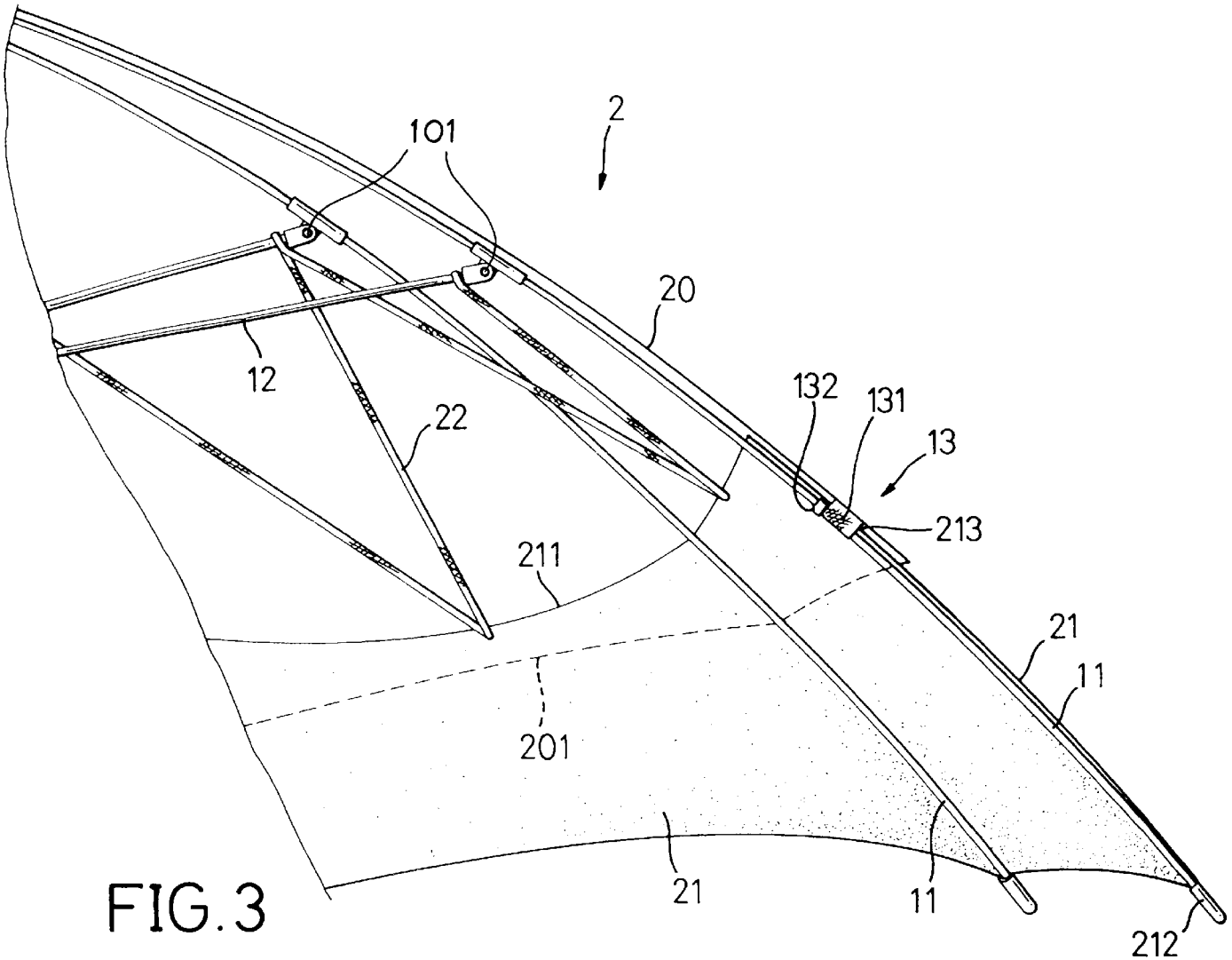
FIG. 3 is a partial perspective view of the ribs, stretchers and panels in accordance with the invention.

FIG. 3 shows how the second panel (21) is kept taut. An elastic cord (22) is secured at a point on the inner periphery (211) of the second panel (21) between adjacent ribs (11).

Figure 4:
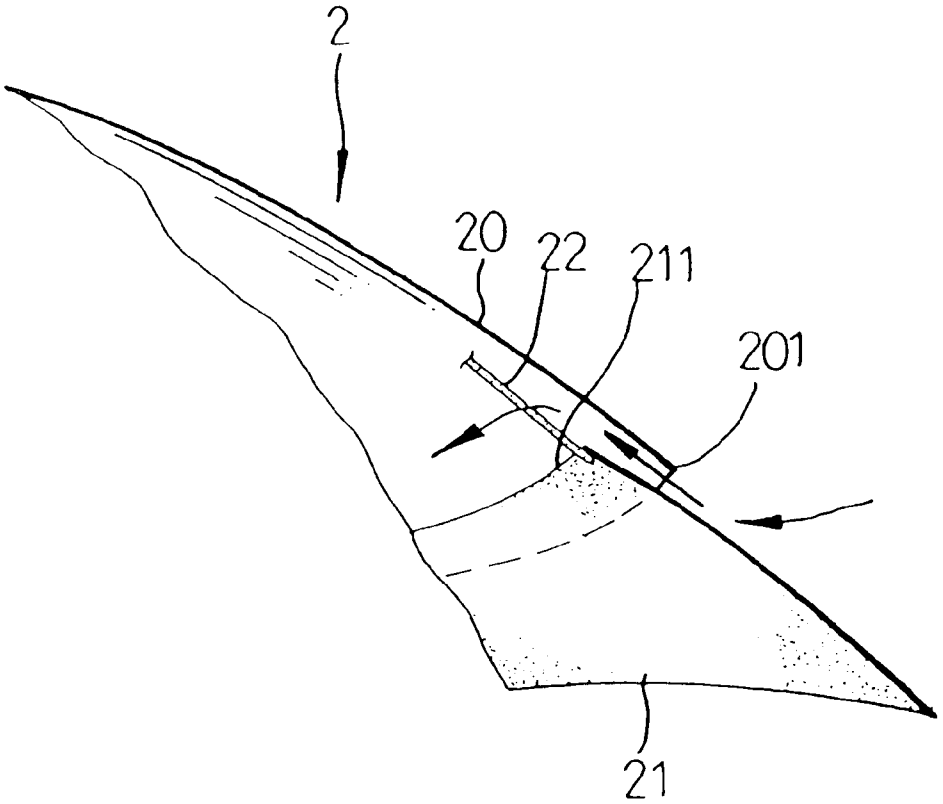
FIG. 4 is a sectional view of the device of FIG. 1 taken along line 4—4, showing the flow of air between the primary and the secondary panels.
Figure 5:
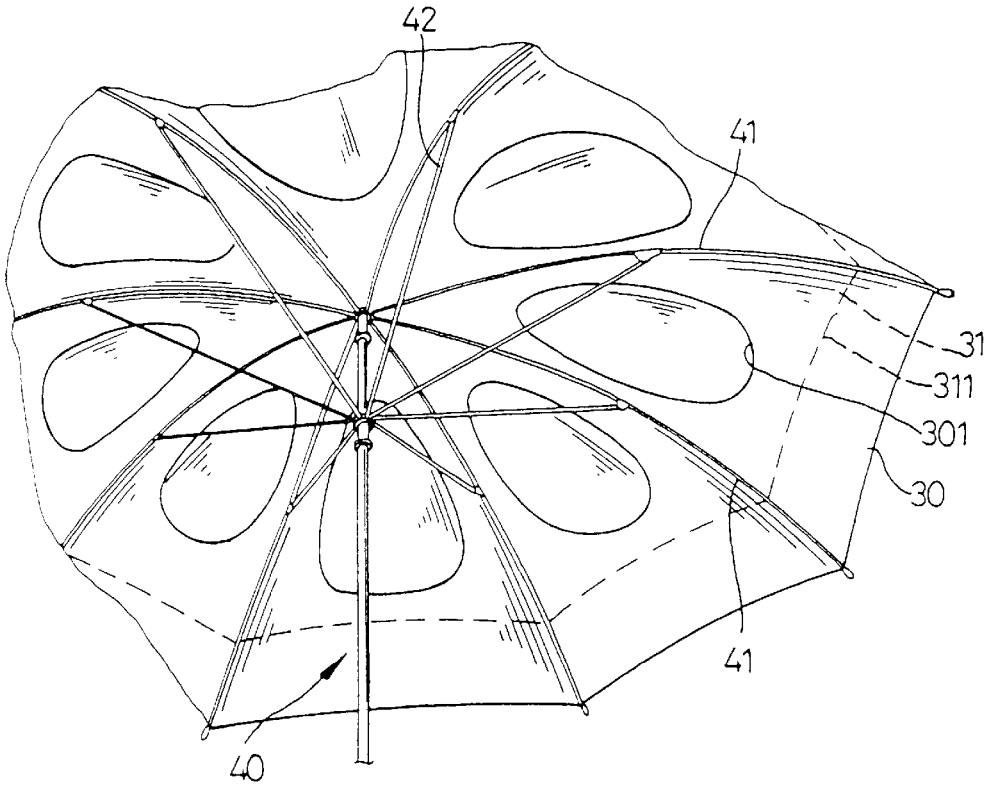
FIG.5 PRIOR ART
FIG. 5 is a bottom perspective view of a conventional parasol.
Figure 6:
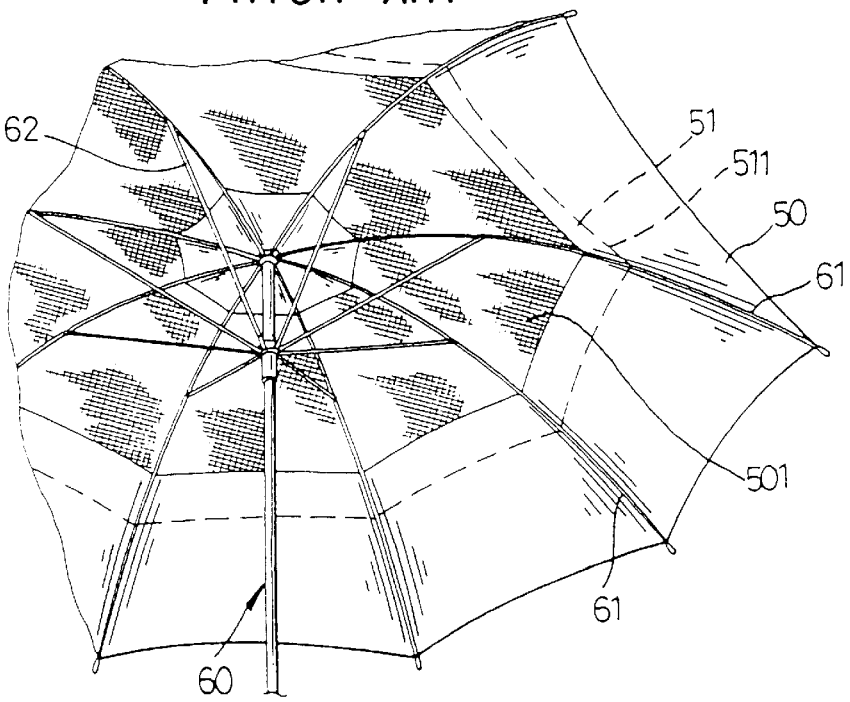
FIG.6 PRIOR ART
FIG. 6 is a bottom perspective view of another conventional parasol.

The user is able to pull the cord (22) toward the stretchers (12) in order to separate the second panel (21) from the first panel (20) and define a gap therebetween. With the gap between the first panel (20) and second panel (21), air is able to freely flow therethrough, as shown in FIG. 4.

Figure 2:
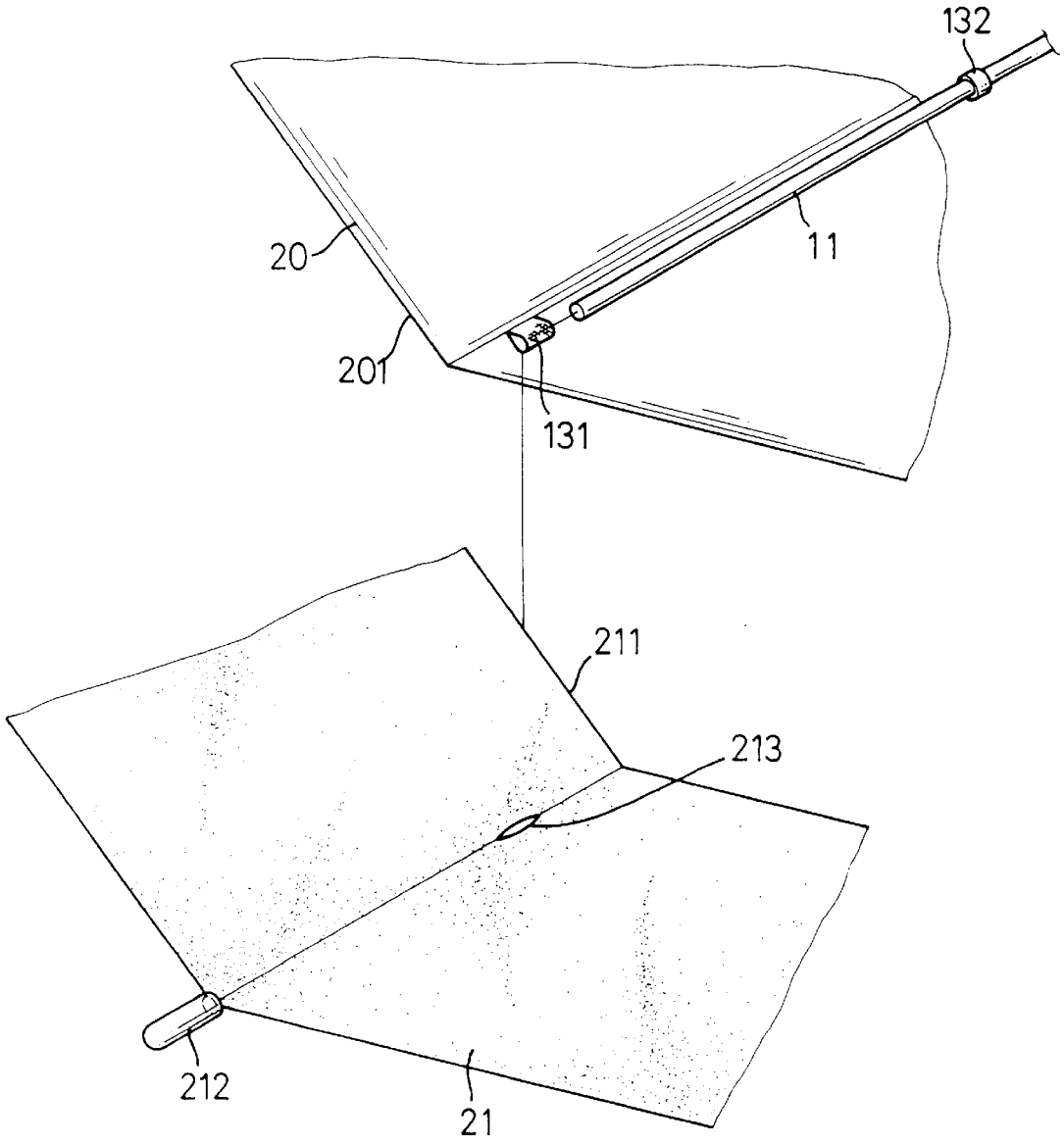
FIG. 2 is a partially exploded view of the end of a rib and the panels in accordance with the invention.

Furthermore, referring again to FIGS. 2 and 3, since conventional parasols are prone to turning inside out, in order to minimize such occurrence, the invention has a plurality of elastic loops (131) that are secured to the first panel (20). Each of the elastic loops (131) corresponds to one of the ribs (11), such that a rib (11) is inserted through a corresponding elastic loop (131). A ring (132) is secured around each of the ribs (11) after the rib (11) is inserted through the elastic loop (131). In order to secure the first panel (20) and the second panel (21) together, the second panel (21) has a plurality of caps (212) and securing slits (213). The caps (212) are attached to the outer periphery of the second panel (21) and each receive an end of one of the corresponding ribs (11), and each of the securing slits (213) is provided at a middle position between the inner and outer peripheries of the second panel (21) and each receive a corresponding one of the ribs (11) therethrough. After the parasol of the present invention is assembled, the elastic loops (131) and the rings (132) will minimize the likelihood that the first panel (20) will turn inside out, and the caps (212) and the securing slits (213) will keep the first panel (20) overlapped over the second panel (21).

The present invention is by no means restricted to the above-described preferred embodiment, but covers all variations that might be implement by using equivalent functional elements or devices that would be apparent to a person skilled in the art, or modifications that fall within in the scope and spirit of the appended claims.

What is claimed is:

1. An improved parasol comprising:

a shaft having an upper portion;

a plurality of ribs each having first and second ends, said ribs each extending radially from the upper portion of said shaft, the first ends of each of the ribs pivotally connected to the upper portion of said shaft;

a nest slidably positioned on the shaft below the upper portion of said shaft;

a plurality of stretchers each attached to the nest and extending radially from the nest and pivotally connected at a joint to a corresponding one of the ribs;

a first panel having an outer periphery, said first panel securely attached to and extending radially from the upper portion of said shaft to points beyond the joints connecting said ribs and said stretchers;

a second panel that is annular shaped and attached to said ribs between the joints and the second ends of said ribs;

a plurality of elastic loops securely located on the outer periphery of said first panel and arranged to each receive a corresponding one of said ribs that are inserted therethrough;

a plurality of rings each detachably connected to a corresponding one of said elastic loops;

a plurality of securing slits provided concentrically on said second panel through each of which a corresponding one of said ribs are inserted therethrough; and a plurality of caps provided on the outer periphery of the second panel and arranged to each receive a corresponding one of said second ends of the ribs.

2. The parasol as claimed in claim 1, wherein an elastic cord is securely attached between said second panel and the joints connecting said ribs and said stretchers.

* * * * *